US005276978A

United States Patent [19]

Hopkins et al.

[11] Patent Number: 5,276,978

[45] Date of Patent: Jan. 11, 1994

[54] TEMPERATURE CONTROLLED CONVEYOR DRYER

[75] Inventors: Riley P. Hopkins, Gig Harbor, Wash.; Rudy H. Mortenson, Moraga; Paul Haussmann, El Cerrito, both of Calif.

[73] Assignee: Hopkins International, Inc., Berkeley, Calif.

[21] Appl. No.: 770,559

[22] Filed: Oct. 3, 1991

[51] Int. Cl.[5] ..... F26B 19/00

[52] U.S. Cl. ..... 34/48; 34/203

[58] Field of Search ..... 34/25, 52, 43, 203, 34/48, 52, 55, 56, 54

[56] References Cited

U.S. PATENT DOCUMENTS 1,741,755 12/1929 Chase et al. ..... 34/203
4,199,871 4/1980 Ward et al. ..... 34/52
4,633,594 1/1987 Bovone ..... 34/48

*Primary Examiner*—Henry A. Bennet
*Attorney, Agent, or Firm*—Brown, Martin, Haller & McClain

[57] ABSTRACT

A temperature controlled conveyor system where a non contact sensor detects the presents of a product to be treated and then supplies a signal to a control device to regulate a radiant heating device. Also the conveyor has an adjustment device to set the optimal distance between the radiant heater and the article being treated.

5 Claims, 4 Drawing Sheets

TEMPERATURE CONTROLLED CONVEYOR DRYER

BACKGROUND OF THE INVENTION

Conveyor dryers or ovens are often utilized where it is necessary to raise the temperature of various article to a specific temperature, and where high production rates are required. Such dryers are frequently utilized in manufacturing of screen printed shirts and other clothing articles. In order for the process to be effective, the dryer must raise the temperature of all of the thermal-setting ink on the garment to a specific temperature range in order to activate the thermal-setting process. If the garment is raised to a temperature substantially greater than the thermal-setting limit, scorching of the material and/or inks can take place. If the garment is not raised to the appropriate temperature, cross-linking of the ink will not take place.

Prior dryers have resolved the conflicting requirements of setting the ink without scorching by utilizing an extremely long heat path. Such dryers may have a heat path as long as 30 to 40 feet. By exposing the garment to the elevated temperatures for an extended period of time, by utilizing a very long heat path, acceptable production rates can be obtained at the expense of considerable energy expenditure and wasted floor space. Such dryers are also expensive to purchase and maintain.

One method used by production dryers to maintain precise temperature control is to vary the distance between the heater and the surface of the garment. Production dryers have raised or lowered the heater elements to maintain the optimum spacing. However, the movement of the heater required flexing electrical connections and an adjust mechanism within the heated chamber. These mechanisms increase the cost and reduce the reliability of the dryer.

There have been conveyor dryers that are capable of bringing a garment up to temperature much more rapidly than the long path dryers. These dryers utilize a combination of radiant heat and heated air flow. The heated air surrounds the garment to supplement the directly radiated heat and raise all portions of the inked surface to the thermal-setting temperature. Such dryers are capable of drying garments in a much shorter conveyor length, and therefore are much more energy and space efficient. However, such dryers are much more sensitive to the maintenance of exact temperatures within the heat chamber and are more sensitive to temperature fluctuations when garments are again placed on the conveyor belt after an interval where there has been an absence of garments.

It is therefore desirable to have a temperature control for conveyor dryers transfer heat to garments at an increased rate. Such a dryer would be particularly desirable where it accurately senses the actual temperature of the garment passing through the dryer and regulates the heaters and belt speed within the chamber to maintain temperatures as close as possible to an optimum set point. It is also desirable to have a temperature control for conveyors that compensates for the temperature draw down effect when the garments are reintroduced to a chamber that had been empty of garments.

SUMMARY OF THE INVENTION

In an exemplary embodiment of the invention, the deficiencies of prior art temperature control for conveyor dryers are overcome in a device that utilizes a non-contact temperature sensor to detect the surface temperature of the articles being dried in a heat chamber. The temperature sensor has a field of view which encompasses the portion of the belt upon which garments are placed, and the portion where a heat stripe has been applied to the belt. The heat stripe is made of a material selected to have absorption and heat emissivity characteristics which closely approximate those of the articles to be dried. The heat stripe responds to the heat flux within said chamber to produce a surface temperature of said stripe which is the same as or predictably offset from the surface temperature of articles passing through the dryer. For example, where the articles to be dried are knitted cotton shirts, the stripe would be selected to have heat absorption and emissivity characteristics comparable to those of the cotton shirts. When garments are present on the conveyor, then the output of the sensor is primarily influenced by the heat emissions from the garment. When no more garments are placed upon the conveyor and the last garment passes the field of view of the sensor, then the output of the sensor is primarily influenced by the emissions from the heat stripe. The combined effect of using non-contact sensing and the heat stripe is to make it possible to maintain the conditions within the chamber in a temperature range that places the chamber in a condition of readiness for the next batch of shirts. When the heat stripe passes out of the chamber, it cools by radiation and convection so that before the heat stripe has again entered the chamber, it has cooled to very close to the ambient temperature (the same temperature as newly printed shirts.) It will therefore be heated to nearly the same temperature as would be a shirt during its passage through the chamber.

When no garments are present in the chamber for a period of time, and then a new batch is introduced, the amount of heat absorbed by the new batch of garments is sufficient (especially in smaller chambers associated with the practice of the invention) to draw the temperature down as much as 20 degrees or more. Since the range of temperatures over which proper fixation takes place, and before scorching becomes a problem, may be as little as 20 degrees, then if the temperature of the chamber is maintained toward the center of the acceptable zone, it has been discovered that the temperature can be drawn-down outside of the acceptable temperature range and result in improperly cured garments. The invention incorporates a shirt proximity sensor near the entrance to the heat chamber. In the exemplary embodiment, the sensor is in the form of a photo detector which is sensitive to a beam of light emanating from the proximity of the sensor, and which passes through the mesh surface of the belt to impinge upon a reflector under the belt, and thereby to return to the sensor. Whenever a shirt interrupts the beam, the output of the sensor changes. After the sensor output indicates that no articles are present, the temperature control is commanded to maintain the temperature at a first set point selected to be at the high end of the range of permitted temperatures and may be referred to as the idle temperature or follow temperature. When shirts enter the heat chamber, they will draw down the temperature of the heat chamber to near the minimum temperature that is still within the range of permitted temperatures. The output of the shirt sensor will indicate the presence of shirts and sequence the temperature controller to the follow temperature or run temperature set point as appropriate. The run temperature set point is midway between the permitted extremes. Operating at the midpoint between the permitted extremes provides the maximum assurance that shirts will neither be scorched nor unset.

In the exemplary embodiment of the invention, a 30-second timer is interposed between the shirt sensor and the temperature controller so that the system does not return to the first set point (follow temperature) until 30 seconds after the last shirt is detected. The 30-second timer inhibits cycling of the heater when there is only a small break between the shirts being sent through the dryer.

In an alternate embodiment of the invention, belt speed as well as thermostatic control of the heater is provided. The objective in controlling the belt speed is to maximize the belt speed as quickly and reliably as possible. Maximum belt speed is determined by the minimum residency time necessary to assure all of the ink on the garment is raised to the thermosetting temperature. When the system is first turned on, belt speed is maintained at a minimum level to draw the thermal stripe through the heat chamber and detect when the chamber is at that temperature when shirts can be properly processed. The system continues to operate at a low conveyor speed until the first set point (idle or follow temperature) is reached. At this time, the signal to the motor controller is increased under thermostatic control until the maximum belt speed is achieved. Thereafter, the belt normally continues to run at maximum speed and the temperature is maintained by thermostatic control of the heaters at the first or second set point as determined by the presence or absence of garments on the belt utilizing the dual set point features of the invention.

The dryer according to the invention controls infrared heat transfer efficiency with a belt riser system. No movement of the heater element is required. A control lever, positioned outside the heated chamber, permits the operator to select a belt height that takes into consideration the thickness of the garments being dried. The lever controls the position of plural belt supports received within the horizontal extent of the heated chamber and between the upper and lower courses of the belt. Raising the supports alters the path of the upper course of the belt toward and away from the radiant heaters.

Heaters built according to the teachings of the invention are much smaller in size and lower in overall cost than dryers built according to the prior art. Each of the principal aspects of the invention makes a contribution to the overall performance of the finished product and collectively they make possible a dryer with improvements both in production rate and efficiency (cost, space and energy.)

The invention will be more fully understood, together with its attendant advantages, by reference to the drawings in which like reference numerals refer to like parts throughout and in which:

DETAILED DESCRIPTION OF THE DRAWINGS

Figure 1:
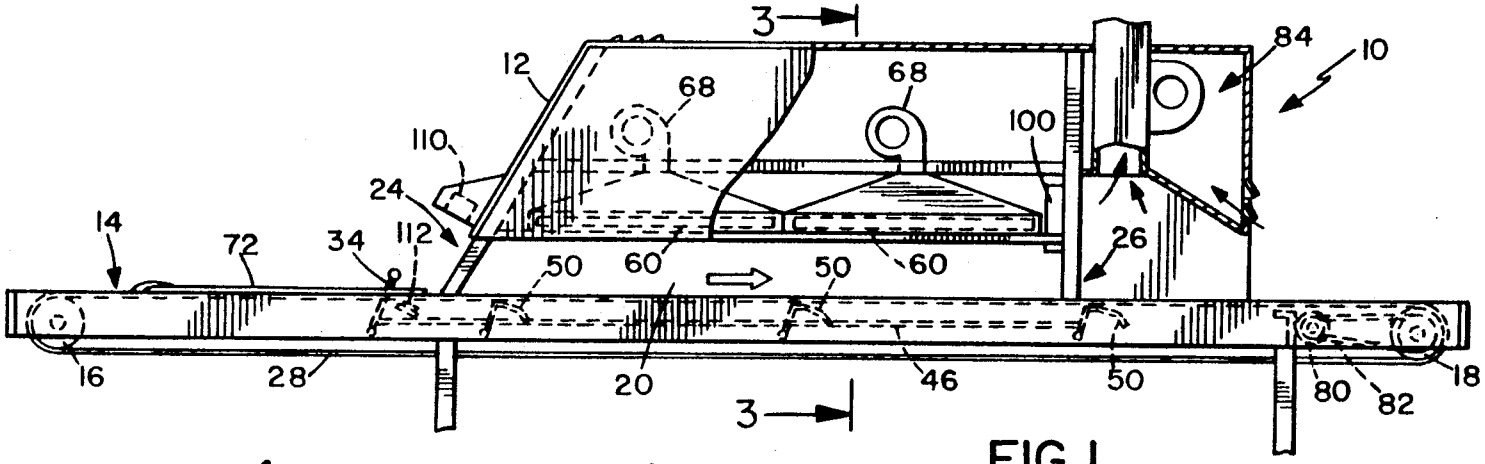
FIG. 1 is a side elevation view of a conveyor-dryer incorporating the features of the invention.
Figure 2:
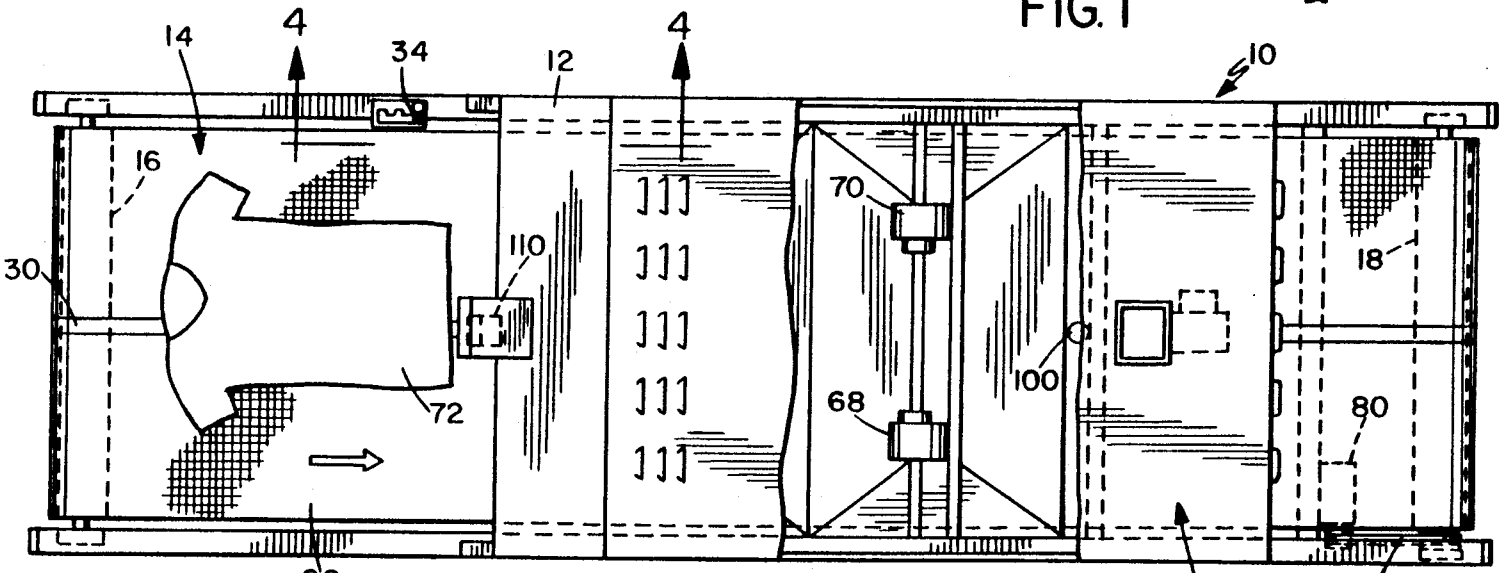
FIG. 2 is a top plan view of the dryer.

Referring now to the drawings, there is illustrated in FIGS. 1 and 2 a conveyor dryer 10 according the invention. The dryer incorporates a heat chamber enclosure 12. A conveyor belt 14 is suspended from rollers 16 and 18 for movement through a heated chamber 20. The upper surface 22 of belt 14 enters the chamber at entry end 24 and exits the chamber at exit opening 26. The underside 28 of the conveyor belt 14 is exposed to the ambient air. The conveyor belt is comprised of a mesh material which allows air flow to pass around and under articles supported on the belt. A centrally located stripe 30 is opaque to infrared heat and exhibits heat absorption and heat emissivity characteristics comparable to that of the articles heated by the conveyor dryer. The stripe must be able to withstand the maximum temperatures encountered in the dryer and the repeated temperature cycling. In the exemplary embodiment, the stripe is comprised of Teflon® fluorocarbon resin treated fiberglass such as the P-Guard product from Chefab. This fabric has been found to be compatible with the characteristics in knitted cotton such as is found on T-shirts and similar garments and therefore to be most closely matched to the principal material which is utilized in screen printing operations.

Figure 4:
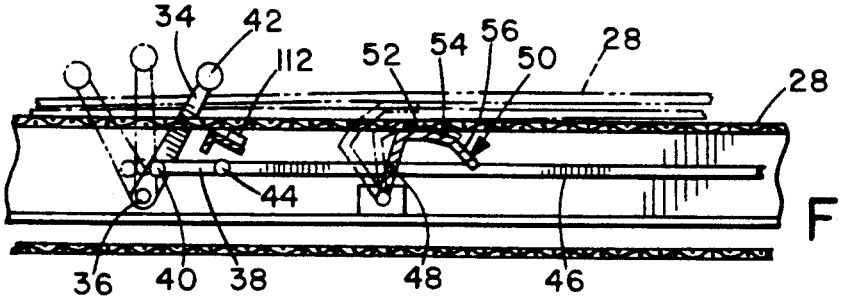
FIG. 4 is a side elevation view of the belt riser mechanism.

Referring particularly to FIG. 4, a belt riser mechanism is illustrated as including a control lever 34 which may be moved between one of three positions, including a first retracted position, a first elevated position and a fully elevated position. The control lever is received on a pivot 36. Movement of the control lever between the several positions causes rotation of the control lever about the pivot. An arm 38 is received on pivot 40 intermediate the pivot 36 and handle end 42 of the control lever 34. Arm 38 is connected through pivot 44 to linkage bar 46. The linkage bar is connected to pivot bearings 48 on multi-planar belt supports 50. Rotation of the control lever 34 forces a translation of the bar, which in turn rotates pivot arms secured to multi-planer belt supports. The planer surfaces of the multi-surface belt supports are produced by a process such as powder coating characterized by a very slick, low friction surface. When the lever is advanced from the initial position to the first elevated position, support surface 52 is rotated out of contact with the belt and the second support surface 54 is rotated into position which causes the belt to become elevated during its passage through the heated chamber. Therefore, articles on the belt will be positioned more closely to the heater. Further rotation of the lever 34 brings the third support surface 56 into planer alignment with the underside of the belt, and causes the maximum elevation of the belt and therefore the smallest clearance between articles on the belt and the heater. Since the amount of infrared energy absorbed by an article is highly dependent upon the distance from the heater, and since the garments may vary in thickness, the belt riser structure permits various thicknesses of garments to be positioned at the optimum distance from the heater.

Figure 3:
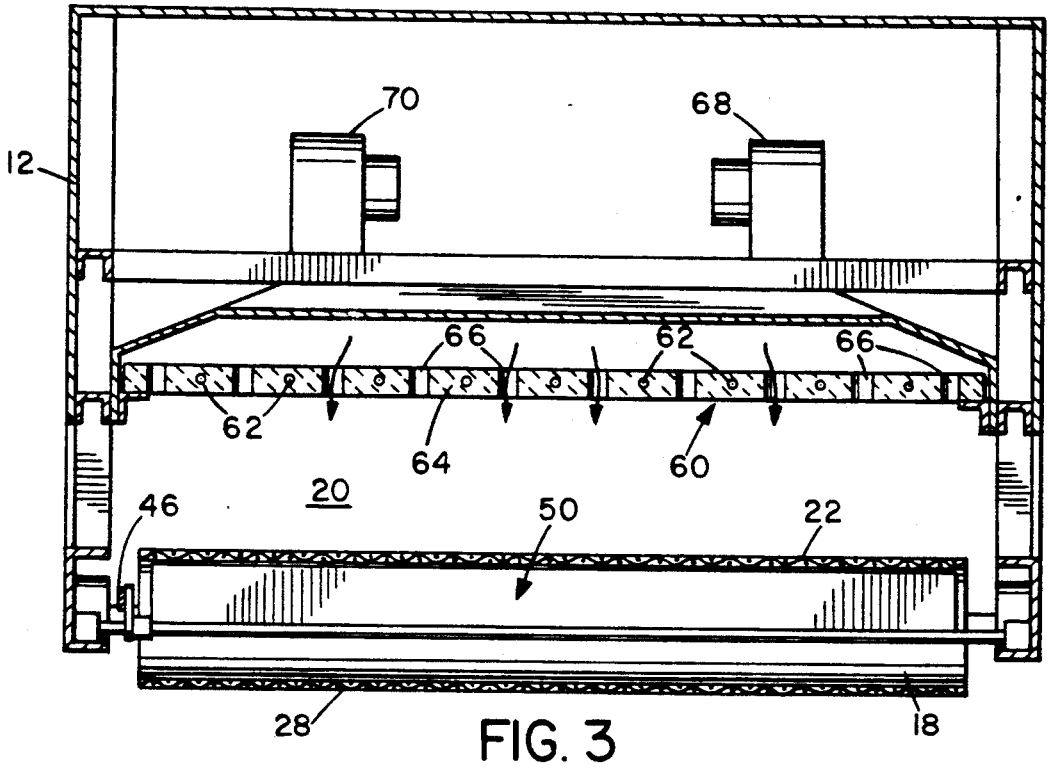
FIG. 3 is a sectional view of the heated chamber taken on line 3—3 of FIG. 1.

Referring particularly to FIG. 3, the heater 60 is illustrated as comprising a series of electrical heating coils 62 embedded in refractory material 64, which may be heated to a temperature at which infrared rays are radiated with good efficiency. The refractory material has a series of bores 66 to allow air from the blowers 68 and 70 to pass through the refractory material and therefore to be heated. The heated air is directed over and under the articles such as the shirt 72 carried on the conveyor belt 14. For this reason, the belt is made of a fine mesh material with openings to permit good air flow and to minimize any tendency for the belt to locally draw down the temperature of the garment being carried on the belt. Therefore, the belt does not have a surface which can easily be scanned by an infrared sensor to determine temperature. For this reason, a thermal stripe 30 is provided. In the preferred embodiment the thermal stripe is at the center of the belt.

The electric motor 80 drives the conveyor belt 14 through the support roller 18 with a chain drive mechanism 82. The exhaust fan 84 at the exit of the heated chamber 20 draws off smoke and chemical fumes from the drying of the ink, and at the same time draws in ambient air which helps to quench-cool the garments so that by the time they exit the conveyor, they can be handled without damage to the printed surfaces.

In the preferred embodiment, the non-contact temperature sensor comprises an infrared sensor 100. A commercially available infrared sensor having characteristics suitable to the practice of the invention is the Cable IT head XXXITXACCB15. The output of the sensor is modified by converter (not shown) such as Raytek J-type convertor model IT ISF, to create a signal comparable to that produced by thermalcouples. In this way, a standard temperature controller 104 may be utilized. A suitable temperature controller is the Omron E5AX-A. The IR sensor 100 is mounted within the chamber housing 12 and near to the exit 26 of the chamber so that it can detect the temperature of the articles passing through the chamber as they reach their maximum temperature.

In the preferred embodiment of the invention, the proximity sensor for determining whether articles are being introduced into the chamber 20 is in the form of a light source co-axial photo detector combined with a retro-reflector 112. A commercially available light source and photo detector is typified by the Banner scanner mini-beam sensor SM24312L. The photo sensor is mounted near the entrance 24 to the heat chamber so as to detect articles as they are about to enter the chamber. The use of a photo detector as a proximity sensor is made possible by the use of the mesh belt. The photo sensor is positioned so that its field of view is down through the upper surface of the mesh belt to a reflector positioned under the upper surface and oriented to redirect at least some of the incident light back to the photo detector. Even though the light makes two passes through the mesh belt, because the mesh is mostly open and because the reflector diffuses the incident light to a sufficiently wide beam, the photo detector is uninfluenced by the operation of the belt. However, when opaque articles are placed on the belt, such as a screen printed T-shirt, the light which passes through the belt and returns to the sensor is reduced or eliminated. The change in returning light changes the output of the sensor. By comparing the sensed output of the proximity sensor to the pre-determined levels consistent with the presence or absence of opaque articles, then it is possible to determine whether there is a article interposed between the sensor and reflector at any given point. This information is utilized to select from at least two temperature set points. After the sensor indicates that no shirts are present, the temperature control will call for the heater to increase the temperature in the chamber (as sensed by the temperature stripe infrared sensor) to the high end extreme of the acceptable range referred to as the idle or follow temperature. In the preferred embodiment, a 30-second timer 114 is utilized to prevent excessive cycling between the follow temperature and nominal (run temperature) set points. The operation of the timer will be discussed in conjunction with the system block diagram.

For most applications of the invention, a single IR sensor operating against a generally centrally mounted thermal stripe is believed to be optimum. However, there will be other applications where a second IR sensor could be utilized, and the broadest aspect of the invention admits of any application where an infrared sensor indirectly senses the surface temperature of the articles when articles are present and where an infrared sensor (the same or an additional sensor) senses the temperature of material within the chamber which has thermal characteristics which are a predictable analog of those of the articles to be treated. For example, a second sensor could have within its field of view a thermal stripe on the underside of one edge of the conveyor belt. Such a sensor would have an output for every temperature of the chamber that would be the same as, or bear a predictable offset to, the temperature sensed by an infrared sensor which has heated articles in its field of view. Control over the oven temperature would be switched to the secondary sensor by the proximity sensor whenever the proximity sensor indicates an absence of articles entering the chamber 20.

Figure 5:
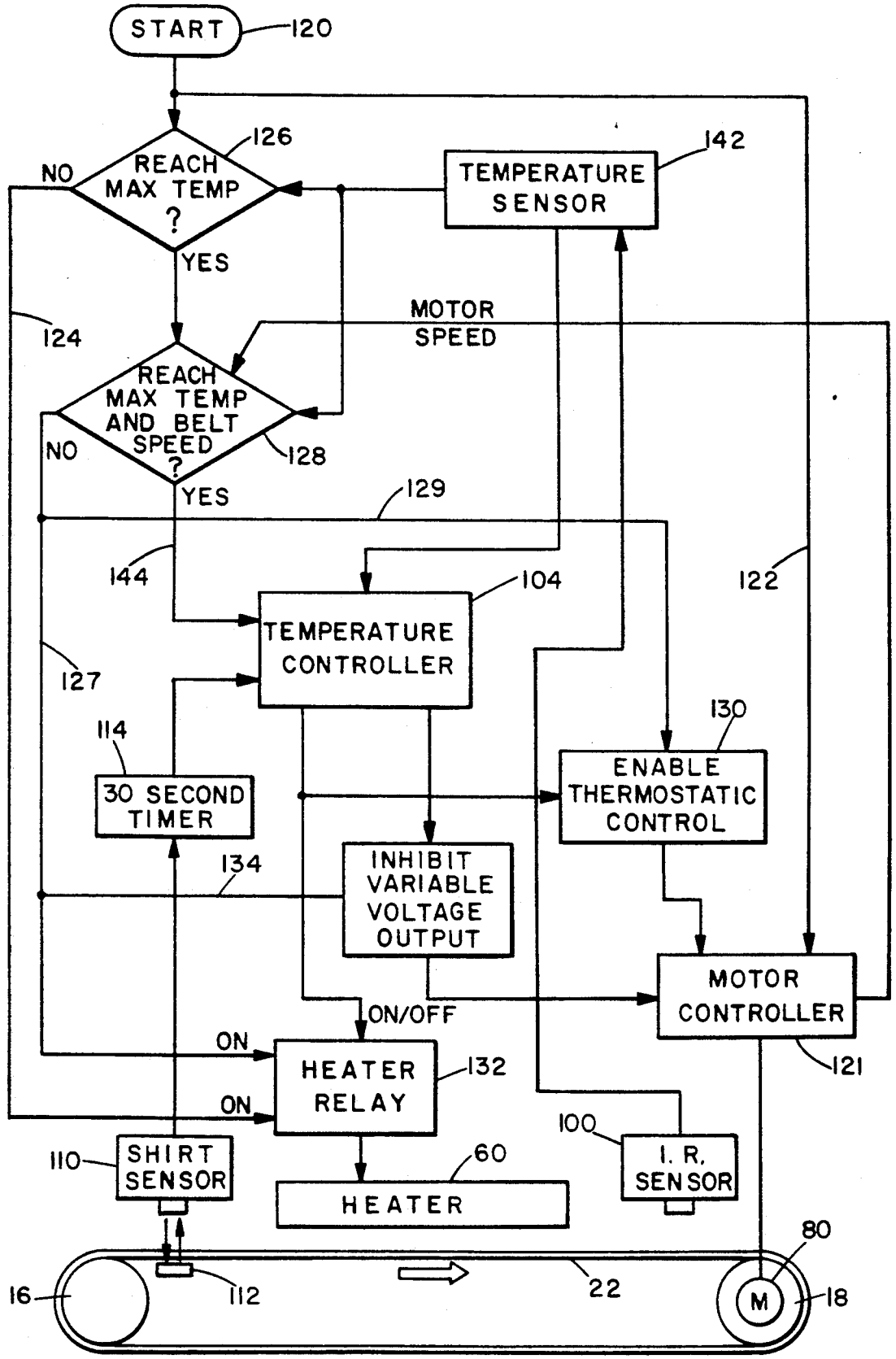
FIG. 5 is a function block diagram, illustrating the logic functions of the temperature and motor control.

Referring to FIG. 5, the system block diagram for the temperature and motor control is illustrated. When the system is first turned on the start controller 120 turns on the motor controller 121 to minimum speed via line 122 and activates the Reach Max Temp logic 126. The motor control may suitably be from KB Electronics, Model KBMM. As long as the maximum temperature (idle or follow) temperature is not reached the heater will be held on via line 124. Once idle temperature is reached at minimum belt speed control is passed to logic block 128 which looks for the co-incidence of maximum belt speed (preset in the motor controller to a minimum of 13 seconds chamber residency) and maximum temperature. Until that condition is reached the NO output on lines 127 and 129 will turn on the Enable Thermostatic Control block 130 which will allow the sensed temperature (at sensor 142) of the heat stripe to determine motor speed. The signal on line 126 maintains the heater 60 on through the heater relay 132. The signal on line 126 (via line 134) inhibit the variable voltage output of the temperature controller 104 until the co-incidence of maximum belt speed and idle temperature.

When maximum belt speed and idle temperature are achieved together the control of the heater is released to the Temperature Controller 104 by a signal on line 144. The temperature controller selects between two set points. The first set point (approximately 375° F.) is the idle temperature. The second set point run temperature (approximately 365° F.) is activated by the shirt sensor 110. The 30-second timer is reset by each garment sensed and therefore produces an output that continuously commands the second set point so long as garments pass at no greater than 30-second intervals.

Figure 6:
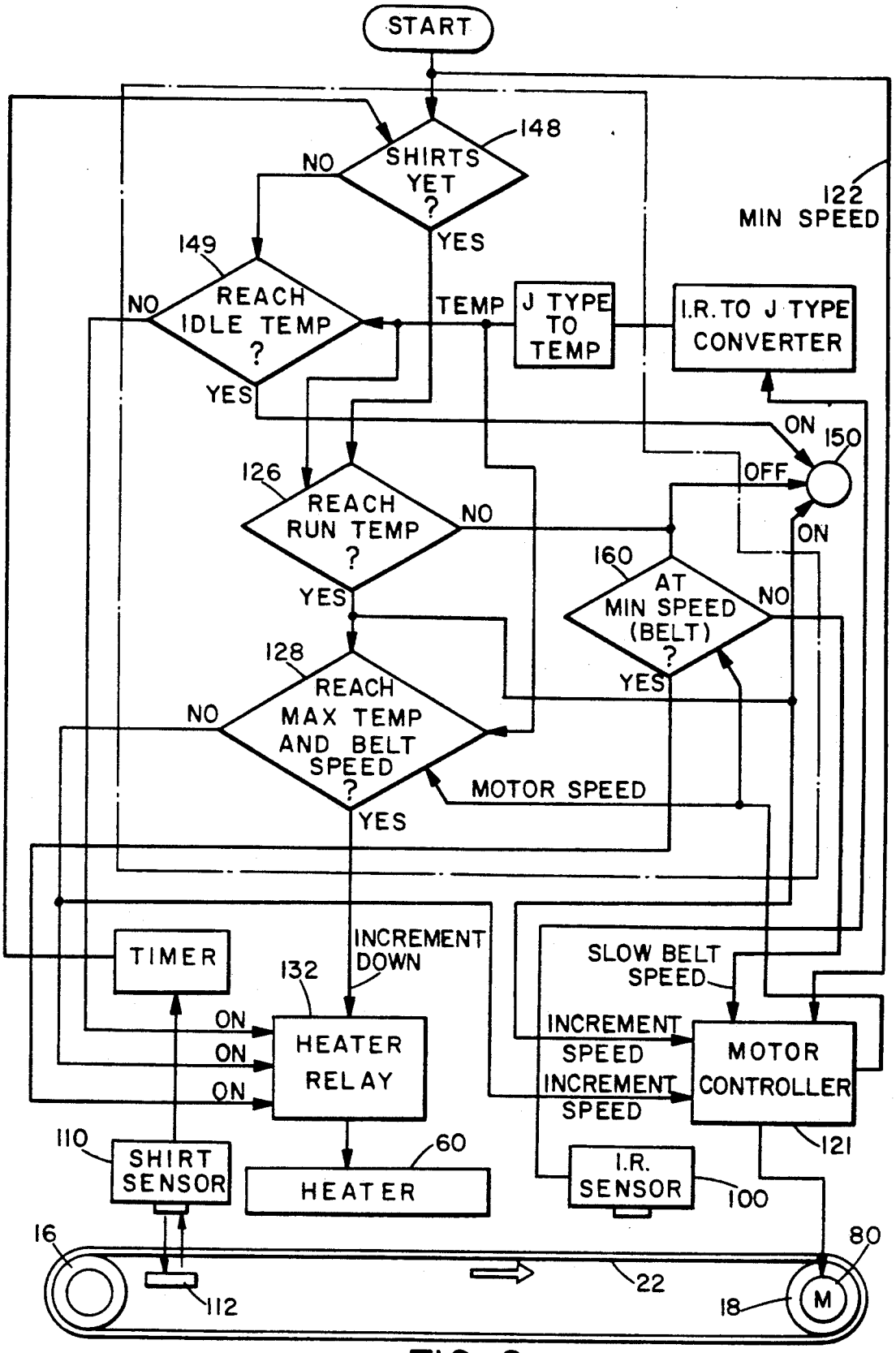
FIG. 6 is a function block diagram illustrating the action of the shirt sensor.

Referring to FIG. 6, when the system is first turned on the start controller 120 turns on the motor controller to minimum speed via line 122. Next the "shirts yet" block 128 controls the run temperature 126 or idle temperature 134 decision. Since this is start up, "no shirts" leads down to "reach idle temperature." This will hold the heaters on at minimum belt speed until idle temperature is achieved. When idle temperature is achieved, the ready light is turned on.

The oven is now warmed up and shirts are expected. If shirts are coming through the dryer and the first shirts temperature is below run set point, the logic block 130 slows down belt to maintain temperature and also turns off ready lite 150. When run temperature is reached, logic block 134 checks for maximum temperature and maximum belt speed. "No" continues to keep heater on maximum and increments belt speed up. "Yes" will cause the heater to produce less heat, allowing the dryer to cool.

It will be evident that there are numerous embodiments of the present invention which, while not expressly described herein, are clearly within the scope and spirit of the invention. The above discussion is therefore intended to be exemplary only, and the actual scope of the invention is to be determined solely by the appended claims.

We claim:

1. A temperature controlled conveyor dryer for drying articles with predetermined heat absorption characteristics comprising:

a conveyor having a belt that may be moved through a dryer chamber, said chamber having a temperature that may be elevated above ambient by heater;

a temperature controller responsive to the output of said temperature sensor and having at least one thermostatic set point;

a temperature sensor for detecting temperatures within said chamber comparing at least one non-contact temperature sensor having a field of view that includes parts of the upper surface of said conveyor belt where articles may be placed for being heated;

a heat stripe on said belt, said stripe being exposed to substantially the same heat flux as are articles placed on the upper surface of said belt; said stripe having heat absorption characteristics and heat emissivity characteristics that result in a surface temperature that has a predetermined relationship to said articles; and a thermostatic control for said heaters responsive to the output of sensed temperature from said non-contact sensor to substantially maintain said temperature at least at one pre-selected set point.

2. A temperature controlled conveyor dryer for drying articles with predetermined heat absorption characteristics comprising:

a conveyor having a belt that may be moved through a heated chamber;

a temperature sensor for detecting temperatures within said chamber;

a thermostatic controller responsive to the output of said temperature sensor and having at least two thermostatic set points;

a proximity sensor with a field of view that includes at least a portion of said conveyor where articles are placed for being heated, and an output that varies dependent upon whether or not articles are present; and said controller selecting a first set point after said proximity sensor output changes to that output indicating the absence of objects and selecting a second set point after said proximity sensor changes to that output indicating the presence of objects.

3. A conveyor dryer for drying articles, comprising:

a drying chamber;

a conveyor belt having an upper substantially horizontal course that may be moved horizontally through said chamber;

said belt being carried between at least two horizontally spaced rollers;

at least one heater supported in said chamber above said belt and directed downwardly onto said upper horizontal course of said belt for drying items on said belt;

the upper course of said belt being supported, within said chamber, by at least one vertically adjustable belt support; and an actuator for selectively indexing said belt support between at least two vertically spaced support positions at different distances from said heater.

4. A temperature controlled conveyor dryer for drying articles with pre-determined heat absorption characteristics, comprising:

a heated chamber having an inlet and an outlet;

at least one heater within said chamber;

a conveyor having a belt extending through said heated chamber between said inlet and said outlet;

a controllable speed motor for driving said belt;

a motor controller for varying the speed of said motor;

said motor controller limiting the maximum speed of said motor to a pre-set speed;

a temperature sensor for detecting the temperature within said chamber;

a temperature controller for controlling operation of said heater in response to the output of said temperature sensor to raise the temperature in said chamber to at least one pre-selected set point, said temperature controller having an output that increases as the sensed temperature in said chamber approaches said pre-selected set point;

said output of said temperature controller causes the motor controller to command increased motor speed as said sensed temperature approaches said set point;

a proximity sensor adjacent said chamber inlet for detecting the presence of articles on said belt and producing an output signal which varies dependent upon whether or not articles are present; and said motor controller being responsive to the output of said proximity sensor to maintain the belt speed below said pre-set speed until said pre-selected temperature is reached if articles are detected when the sensed temperature is below said pre-selected set point temperature.

5. The conveyor dryer as claimed in claim 2, including delay means for delaying any no article present output from said proximity sensor for a predetermined time period corresponding to an average gap between articles on said belt to maintain the temperature at said lower second level unless no articles are detected for a time period longer than said predetermined time period.

* * * * *

UNITED STATES PATENT AND TRADEMARK OFFICE

CERTIFICATE OF CORRECTION

PATENT NO. : 5,276,978
DATED : January 11, 1994
INVENTOR(S) : Riley P. Hopkins, et al.

It is certified that error appears in the above-indentified patent and that said Letters Patent is hereby corrected as shown below:

Column 6, line 55, change "126" to --127--; and
line 57, change "126" to --127--;
Column 7, line 3, delete "when" and insert: --an alternative embodiment is illustrated in which belt speed control is also provided. When--;
line 6, change "128" to --148--;
line 7, change "134" to --149--;
line 15, change "130" to --160--; and
line 17, change "134" to --128--.

Signed and Sealed this
Fifteenth Day of November, 1994

*Attest:*

Bruce Lehman

BRUCE LEHMAN

*Attesting Officer*

*Commissioner of Patents and Trademarks*